US009028508B2

(12) United States Patent
Holzbauer et al.

(10) Patent No.: US 9,028,508 B2
(45) Date of Patent: May 12, 2015

(54) EPILATING APPARATUS

(75) Inventors: Juergen Holzbauer, Maria Rain (AT); Ferdinand Sereinig, Velden/Worthersee (AT)

(73) Assignee: Koninklijke Philips N.V., Eindhoven (NL)

( * ) Notice: Subject to any disclaimer, the term of this patent is extended or adjusted under 35 U.S.C. 154(b) by 1809 days.

(21) Appl. No.: 11/911,645

(22) PCT Filed: Apr. 12, 2006

(86) PCT No.: PCT/IB2006/051122

§ 371 (c)(1),
(2), (4) Date: Oct. 15, 2007

(87) PCT Pub. No.: WO2006/111887

PCT Pub. Date: Oct. 26, 2006

(65) Prior Publication Data

US 2009/0270883 A1 Oct. 29, 2009

(30) Foreign Application Priority Data

Apr. 18, 2005 (EP) ..... 05103050

(51) Int. Cl.
*A61B 17/50* (2006.01)
*A45D 26/00* (2006.01)

(52) U.S. Cl.
CPC ..... *A45D 26/0028* (2013.01); *A45D 26/0057* (2013.01)

(58) Field of Classification Search
CPC ..... A45D 26/0023–26/0061
USPC ..... 606/131, 133
See application file for complete search history.

(56) References Cited

U.S. PATENT DOCUMENTS

| | | | | |
|---|---|---|---|---|
| 4,524,772 | A * | 6/1985 | Daar et al. | 606/133 |
| 4,901,723 | A * | 2/1990 | Platek | 606/133 |
| 4,935,024 | A * | 6/1990 | Dolev | 606/133 |
| 5,011,485 | A * | 4/1991 | Daar et al. | 606/133 |
| 5,057,115 | A * | 10/1991 | Dolev | 606/133 |
| 5,078,715 | A * | 1/1992 | Daar et al. | 606/133 |
| 5,100,413 | A * | 3/1992 | Dolev | 606/133 |
| 5,234,441 | A * | 8/1993 | Heintke et al. | 606/133 |
| 5,261,919 | A * | 11/1993 | Niedertscheider | 606/133 |
| 5,312,419 | A | 5/1994 | Garenfeld et al. | |
| 5,507,753 | A * | 4/1996 | Iwasaki et al. | 606/133 |
| 5,857,903 | A * | 1/1999 | Ramspeck et al. | 452/82 |
| 6,436,106 | B2 * | 8/2002 | Yiu | 606/133 |
| 6,824,546 | B1 | 11/2004 | Yiu | |
| 2005/0216035 | A1 * | 9/2005 | Kraus et al. | 606/133 |
| 2007/0066979 | A1 * | 3/2007 | Beytollahi | 606/133 |

FOREIGN PATENT DOCUMENTS

| | | |
|---|---|---|
| CN | 2469714 Y | 1/2002 |
| DE | 4334850 A1 | 5/1994 |

(Continued)

*Primary Examiner* — Katherine Dowe
*Assistant Examiner* — Jonathan Hollm

(57) ABSTRACT

The present invention is directed to an epilating apparatus (10) comprising a first disc assembly (12) arranged in a first row (14) and at least a second disc assembly (16) arranged in a second row (18), wherein during operation of the apparatus (10) the first disc assembly (12) and the second disc assembly (16) rotate (substantially) in a same direction. In accordance with a first aspect of the invention, a circumferential speed of the first disc assembly (12) is different from a circumferential speed of the second disc assembly (16). In accordance with a second aspect of the invention, the first disc assembly and the second disc assembly are arranged angularly relative to each other.

10 Claims, 4 Drawing Sheets

(56) References Cited

FOREIGN PATENT DOCUMENTS

| | | | | |
|---|---|---|---|---|
| DE | 4427788 | A1 | | 2/1996 |
| EP | 1046355 | A2 | | 10/2000 |
| EP | 0738481 | B1 | | 8/2001 |
| JP | 2002125749 | A | | 5/2002 |
| WO | WO 2004033164 | A1 | * | 4/2004 |
| WO | WO 2005002386 | A1 | * | 1/2005 |

* cited by examiner

EPILATING APPARATUS

The present invention relates to an epilating apparatus comprising a first disc assembly arranged in a first row and at least a second disc assembly arranged in a second row, wherein during operation of the apparatus the first disc assembly and the second disc assembly rotate (substantially) in a same direction.

Figure 1A:
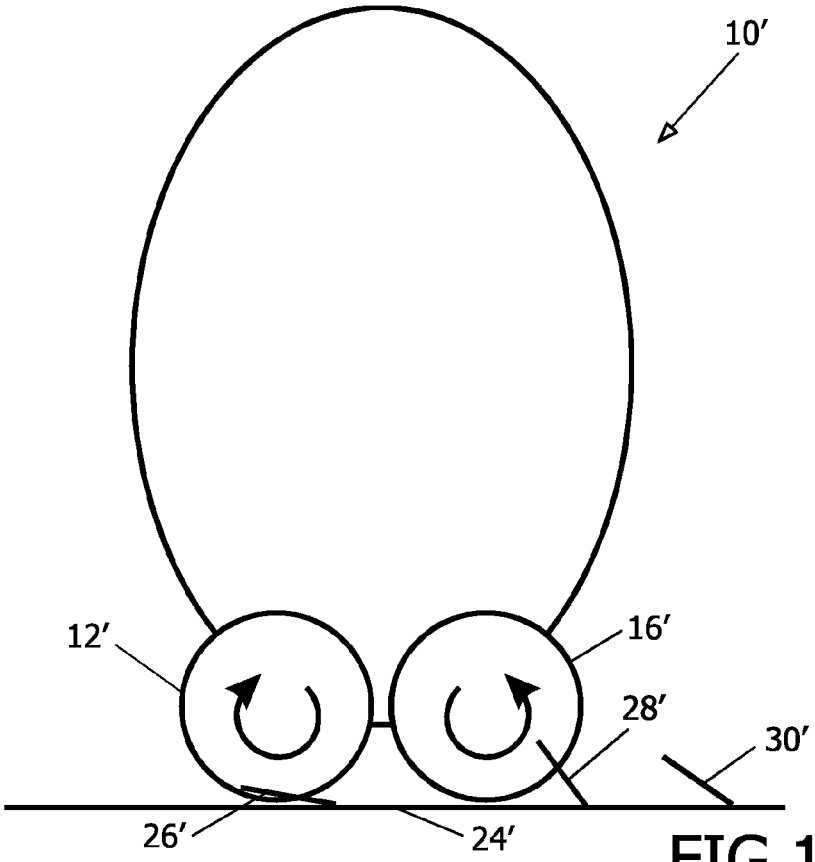
FIG.1a Prior Art
Figure 1B:
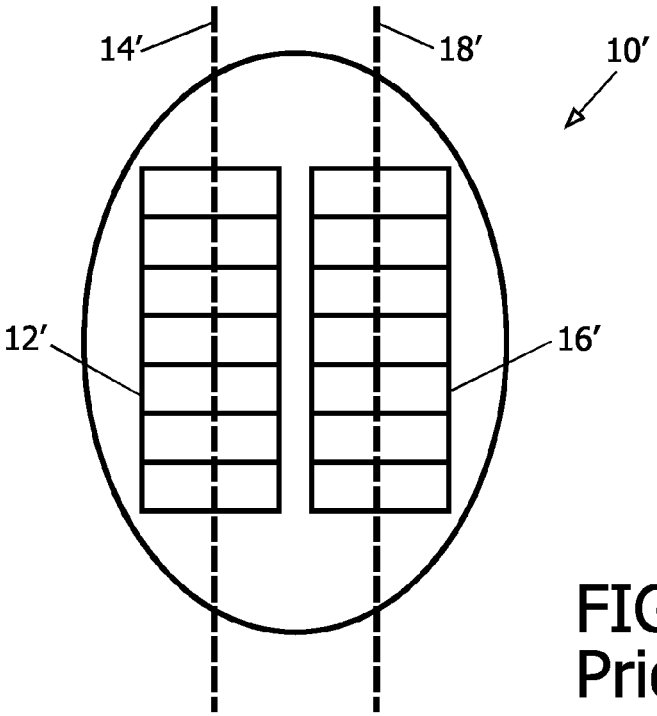
FIG.1b Prior Art

An epilating apparatus of the type mentioned above is known from U.S. Pat. No. 6,824,546 B1. In general, the epilating process can be divided into the steps of catching the hair, clamping the hair, and finally plucking the hair out. The favorite direction to catch the hair is the direction opposite to the natural growth direction of the hair. As even efficient epilating apparatuses are not able to catch all hairs with one stroke, it is known, for example from U.S. Pat. No. 6,824,546 B1, to arrange two disc assemblies behind each other, which rotate in the same direction. A further possibility, also known from U.S. Pat. No. 6,824,546 B1, is to rotate the two disc assemblies arranged behind each other in opposite directions such that the skin between the two disc assemblies is stretched. This is shown in FIGS. 1*a* and 1*b*, wherein FIG. 1*a* shows a schematic sectional view of a prior art epilating apparatus 10' during operation on skin 24 and FIG. 1*b* shows a schematic top view on the active surface of the prior art epilating apparatus 10'. The epilating apparatus 10' comprises a first disc assembly 12' arranged in a first row 14' and a second disc assembly 16' arranged in a second row 18'. The first disc assembly 12' and the second disc assembly 16' are rotated in opposite directions, as shown by the arrows. As a result, the skin 24' between the disc assemblies 12', 16' is stretched, and this leads to an advantageous tension distribution in the skin 24', with a minimized stimulation of the free nerve ends which are responsible for the pain sensation. However, rotating the disc assemblies 12', 16' in opposite directions leads to a lower efficiency of the epilating process, because one of the disc assemblies, namely the disc assembly 12', is rotated in an inconvenient direction to catch hairs 26', 28', 30', and thereby hairs can be pressed down as illustrated for the hair 26'. Furthermore, rotating the disc assemblies 12', 16' in opposite directions leads to a bad maneuverability of the epilating apparatus 10' on the skin of the user.

It is an object of the present invention to provide epilating apparatuses of the type mentioned in the opening paragraph, which offer a skin-stretching function but nevertheless have both a good maneuverability and a high efficiency.

This object is achieved by the features of the independent claims. Further developments and preferred embodiments of the invention are outlined in the dependent claims.

In accordance with a first aspect of the present invention, there is provided an epilating apparatus comprising a first disc assembly arranged in a first row and at least a second disc assembly arranged in a second row, wherein during operation of the apparatus the first disc assembly and the second disc assembly rotate in a same direction, and wherein a circumferential speed of the first disc assembly is different from a circumferential speed of the second disc assembly. The different circumferential speeds of the disc assemblies also provide a skin stretching effect, but both disc assemblies can be rotated in the favorite direction to catch the hairs, i.e. in the direction opposite to the natural growth direction of the hairs. Furthermore, rotating the disc assemblies in the same direction leads to a good maneuverability of the epilating apparatus.

In accordance with a first embodiment of the invention, a rotation speed of the first disc assembly is different from a rotation speed of the second disc assembly to generate the different circumferential speeds.

In such a case it is preferred that a diameter of the first disc assembly is equal to a diameter of the second disc assembly. With such a solution the disc assemblies can be identical, and this leads to lower production costs.

In accordance with a second embodiment of the invention, a diameter of the first disc assembly is different from a diameter of the second disc assembly to generate the different circumferential speeds.

In such a case it is preferred that a rotation speed of the first disc assembly is equal to a rotation speed of the second disc assembly. It is clear to the person skilled in the art that the above first and second embodiments can be combined, if this is regarded as useful.

In accordance with a further development of the invention, the epilating apparatus further comprises a third disc assembly arranged in a third row and intended to rotate in the same direction as the first disc assembly and the second disc assembly, wherein the first disc assembly is arranged in front of the second disc assembly and the third disc assembly is arranged alongside the second disc assembly. In such a case it is, for example, possible that the three disc assemblies have the same width and that only the skin in a middle area is treated by two disc assemblies, while skin in the outer areas is treated by only one disc assembly.

In accordance with a second aspect of the present invention, there is provided an epilating apparatus comprising a first disc assembly and at least a second disc assembly, wherein during operation of the apparatus the first disc assembly and the second disc assembly rotate substantially in a same direction, and wherein the first disc assembly and the second disc assembly are arranged angularly relative to each other. If the angle between the first and the second disc assembly is suitably selected, such an arrangement of the disc assemblies also provides a skin stretching effect, but both disc assemblies can be rotated substantially in the favorite direction to catch the hairs, i.e. in the direction opposite to the natural growth direction of the hairs. Furthermore, rotating the disc assemblies in substantially the same direction leads to a good maneuverability of the epilating apparatus.

In this context it is preferred that the first disc assembly is arranged in a first row and that the second disc assembly is arranged in a second row, wherein the first row and the second row include a first angle between 175° and 135°, preferably between 170° and 140°, and most preferably between 160° and 150°.

Also, in connection with the second aspect of the invention, it is possible that the epilating apparatus comprises a third disc assembly, wherein the first disc assembly and the third disc assembly are arranged angularly relative to each other. With such an arrangement it is, for example, possible that the disc assembly in the middle is rotated in the favorite direction to catch the hairs, while the two outer disc assemblies are rotated only substantially in the favorite direction to provide the skin stretching function.

As regards a suitable choice of the further angle, it is preferred that the first disc assembly is arranged in a first row and that the third disc assembly is arranged in a third row, wherein the first row and the third row include a second angle between 175° and 135°, preferably between 170° and 140°, and most preferably between 160° and 150°.

The above and further aspects and advantages of the invention will be apparent from and elucidated with reference to the embodiments described hereinafter and shown in the drawings, wherein FIG. 1*a* shows a schematic sectional view of a prior art epilating apparatus during operation on skin, as discussed above;

FIG. 1*b* shows a schematic top view on the active surface of the prior art epilating apparatus of FIG. 1*a;*

Figure 2A:
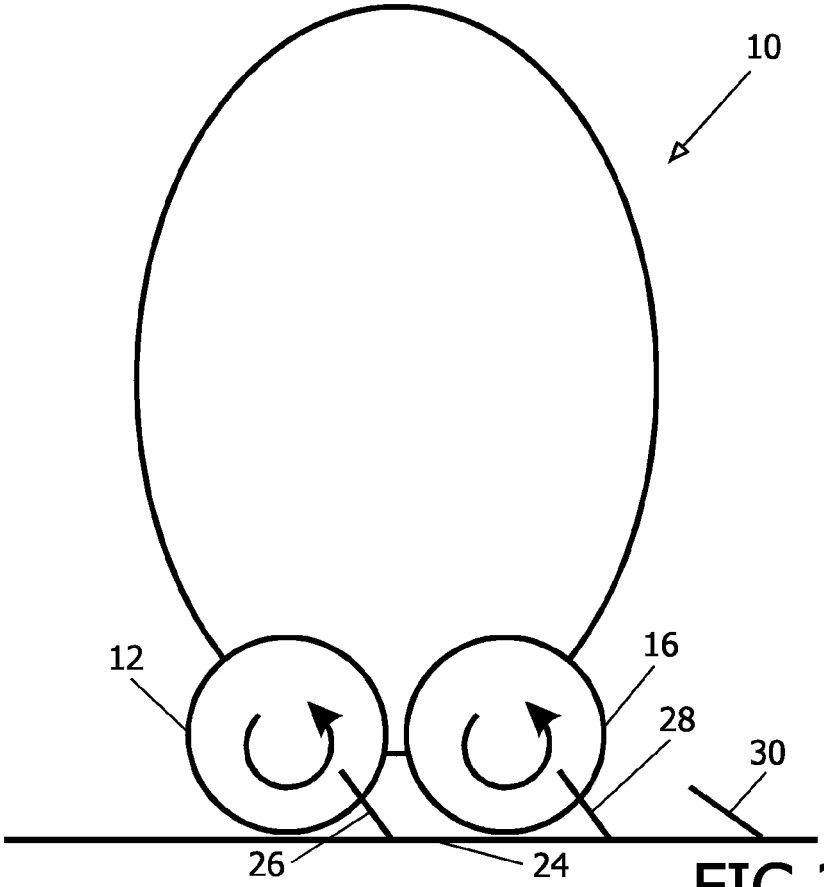
Figure 2B:
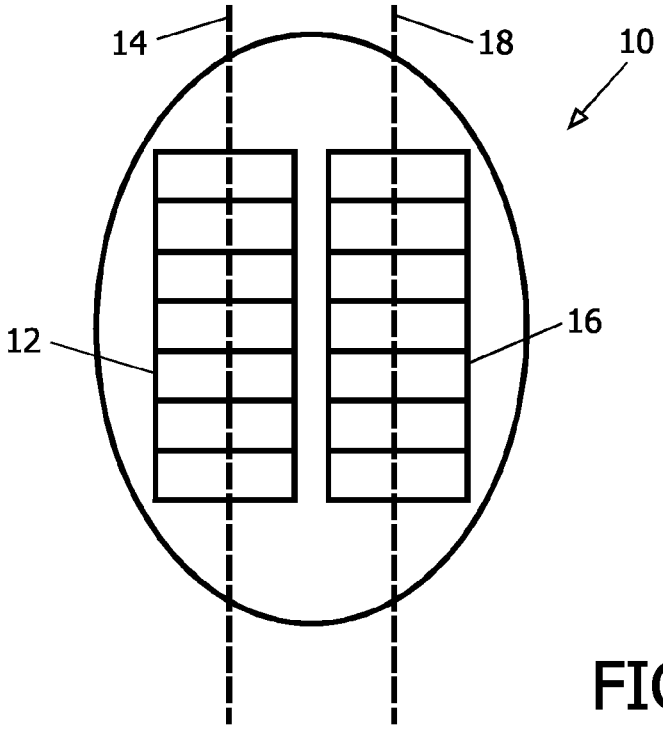

FIG. 2*a* shows a schematic sectional view of a first embodiment of the epilating apparatus in accordance with the invention;

FIG. 2*b* shows a schematic top view on the active surface of the epilating apparatus of FIG. 2*a;*

Figure 3A:
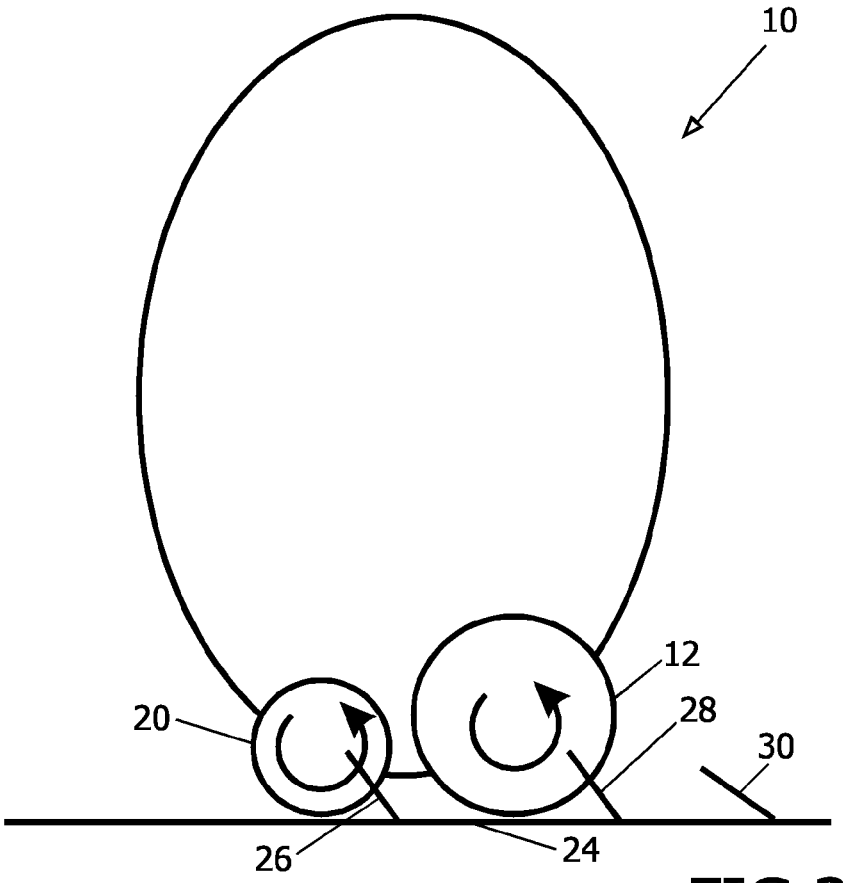
Figure 3B:
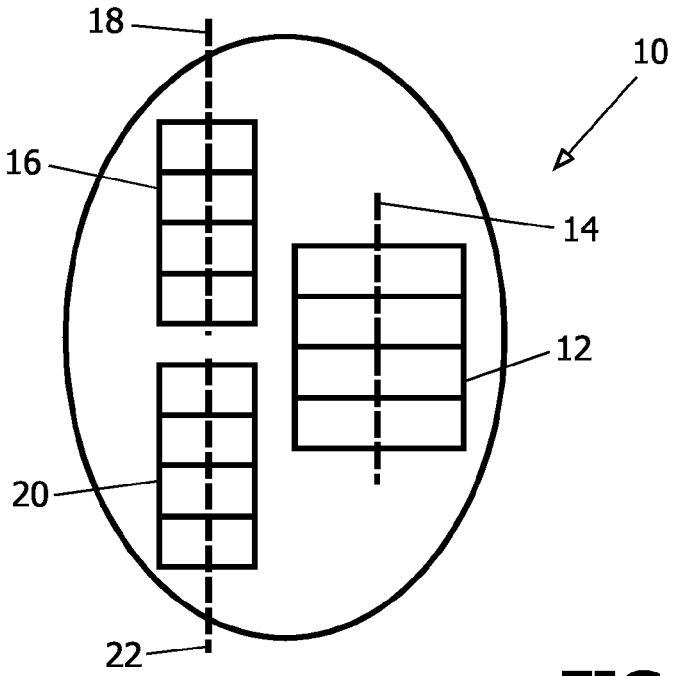

FIG. 3*a* shows a schematic sectional view of a second embodiment of the epilating apparatus in accordance with the invention;

FIG. 3*b* shows a schematic top view on the active surface of the epilating apparatus of FIG. 3*a;*

Figure 4A:
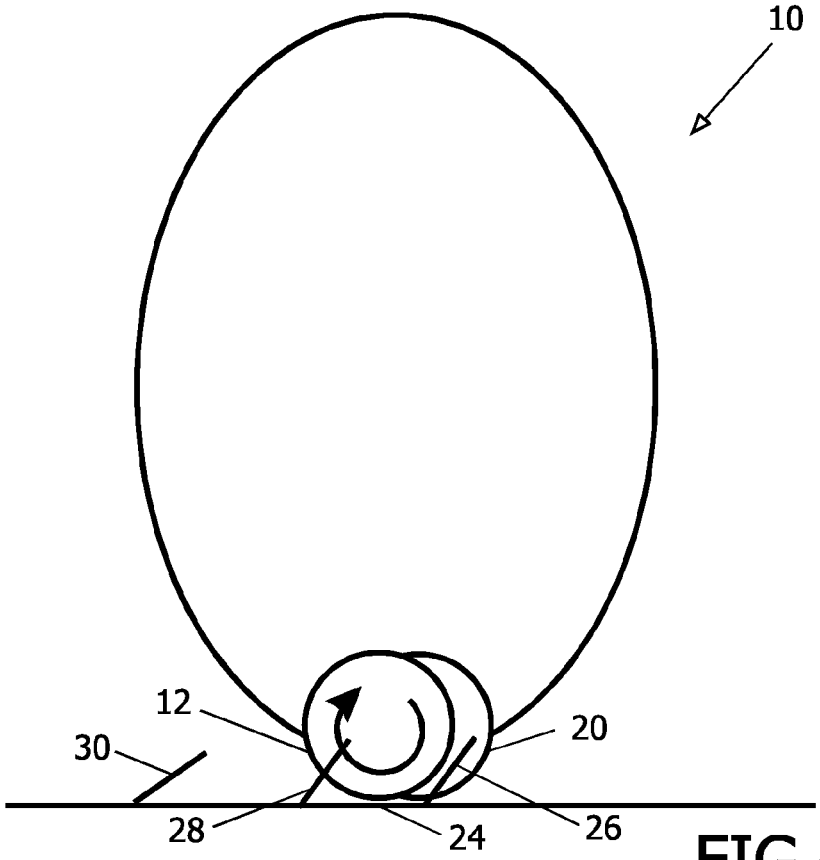
Figure 4B:
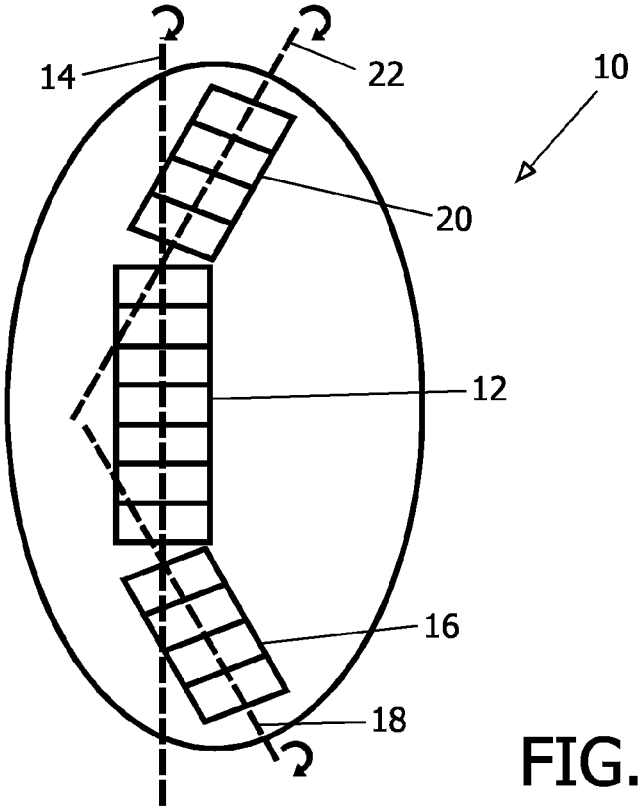

FIG. 4*a* shows a schematic sectional view of a third embodiment of the epilating apparatus in accordance with the invention; and FIG. 4*b* shows a schematic top view on the active surface of the epilating apparatus of FIG. 4*a*.

Throughout the drawings, equal or similar reference numerals are used to denote equal or similar components, and at least some of these components are explained only once to avoid repetitions.

FIGS. 2*a* and 2*b* show a first embodiment of the epilating apparatus 10 in accordance with the invention. The epilating apparatus 10 comprises a first disc assembly 12 arranged in a first row 14 and a second disc assembly 16 arranged in a second row 18. As may be best seen in FIG. 2*b*, the two rows 14, 18 are arranged in parallel with this first embodiment. The structure of the disc assemblies 12, 16, or rolls of tweezers, as such is well known to the person skilled in the art and is therefore not discussed herein. In accordance with the first embodiment shown in FIGS. 2*a* and 2*b*, the disc assemblies 12, 16 are rotated in the same direction, as indicated by the arrows in FIG. 2*a*, but at different rotational speeds. Since the disc assemblies 12, 16 have the same diameter, the different rotational speeds lead to different circumferential speeds. If the second disc assembly 16 is rotated at a higher speed than the first disc assembly 12, the skin 24 between the disc assemblies 12, 16 is stretched, and this leads to an advantageous tension distribution in the skin 24, with a minimized stimulation of the free nerve ends which are responsible for the pain sensation. Furthermore, both disc assemblies 12, 16 are rotated in the favorite direction to catch the hairs 26, 28, 30, i.e. in the direction opposite to the natural growth direction of the hairs 26, 28, 30. Thereby a high efficiency is achieved and the maneuverability of the epilating apparatus 10 is excellent.

FIGS. 3*a* and 3*b* show a second embodiment of the epilating apparatus 10 in accordance with the invention. The epilating apparatus 10 comprises a first disc assembly 12 arranged in a first row 14, a second disc assembly 16 arranged in a second row 18, and a third disc assembly 20 arranged in a third row 22. As may be best seen in FIG. 3*b*, the third disc assembly 20 is arranged alongside the second disc assembly 16, and the first disc assembly 12 is arranged in front of the second and third disc assemblies 16, 20, in respect of the preferred direction of movement of the epilating apparatus 10. The diameter of the first disc assembly 12 is about 1.5 times the diameter of the second and third disc assemblies 16, 20. Therefore, if all disc assemblies 12, 16, 20 are rotated in the indicated directions, for example, at the same rotation speeds, the circumferential speed of the first disc assembly 12 is higher than the circumferential speeds of the other disc assemblies 16, 20. This also leads to the desired stretching of the skin 24 between the disc assemblies 12, 16, 20. With the second embodiment, illustrated in FIGS. 3*a* and 3*b*, only the skin 24 in the middle area is treated by two disc assemblies 12 and 16 or 12 and 20. The skin 24 in the outer areas is treated by only one disc assembly 16 or 20. Also in this case all disc assemblies 12, 16, 20 are rotated in the favorite direction to catch the hairs 26, 28, 30, i.e. in the direction opposite to the natural growth direction of the hairs 26, 28, 30, providing a high efficiency and an excellent maneuverability of the epilating apparatus 10.

FIGS. 4*a* and 4*b* show a third embodiment of the epilating apparatus 10 in accordance with the invention. The illustrated epilating apparatus 10 comprises a first disc assembly 12 arranged in a first row 14, a second disc assembly 16 arranged in a second row 18, and a third disc assembly 20 arranged in a third row 22. During operation of the apparatus 10, the first disc assembly 12, the second disc assembly 16, and the third disc assembly 20 are rotated substantially in the same direction, as indicated by the arrows. The disc assemblies 12, 16, 20 may have, without being limited thereto, the same diameter. Furthermore, the circumferential speeds of all disc assemblies 12, 16, 20 can be the same, since, in this embodiment, the skin-stretching effect is achieved by the fact that the disc assemblies 12, 16, 20 shown in FIGS. 4*a* and 4*b* are rotated only "substantially" in the same direction. This is due to the fact that, to achieve the skin-stretching effect, the first row 14 includes an angle of, for example, about 155° with both the second row 18 and the third row 22, as illustrated. Such an arrangement does not really affect the maneuverability of the epilating device 10, but leads to a high efficiency of the epilating process with reduced pain.

Finally, it is to be noted that equivalents and modifications not described above may also be employed without departing from the scope of the invention, which is defined in the accompanying claims. Particularly, it is clear to the person skilled in the art that the above solutions in accordance with the first and second aspects can be combined without problem, if this is regarded as advantageous, and also such embodiments shall be regarded as being disclosed herein.

The invention claimed is:

1. An epilating apparatus comprising:

a first disc assembly having a first diameter arranged in a first row for rotating in a first direction; and at least one second disc assembly ranged in a corresponding at least one second row for rotating in the first direction, wherein a circumferential speed of the first disc assembly rotating in the first direction during operation is different from a circumferential speed of the at least one second disc assembly rotating in the first direction during operation at a same time as the first disc assembly regardless of a diameter of the at least one second disc assembly to together impart a stretching effect on a surface in contact with both the first and at least one second disc assemblies during operation, wherein the at least one second disc assembly has a higher rotational speed than the first disc assembly.

2. The epilating apparatus according to claim 1, wherein the at least one second disc assembly is positioned first before the first disc assembly in a direction of movement of the epilating apparatus during operation.

3. The epilating apparatus according to claim 2, wherein a diameter of the first disc assembly is equal to a diameter of the at least one second disc assembly.

4. The epilating apparatus according to claim 1, wherein the first diameter of the first disc assembly is different from a diameter of the at least one second disc assembly.

5. The epilating apparatus according to claim 4, wherein the at least one second disc assembly is at least two second disc assemblies and a rotation speed of a first one of the second disc assemblies is equal to a rotation speed of a second one of the second disc assemblies.

6. The epilating apparatus according to claim 1, further comprising two second disc assemblies, each arranged in a row for rotating in the same direction as the first disc assembly, wherein the first disc assembly is arranged in front of the second disc assemblies and the at least two second disc assemblies are arranged alongside each other.

7. The epilating apparatus according to claim 1, wherein the first and at least one second rows are arranged along a same line angularly relative to each other.

8. The epilating apparatus according to claim 7, wherein the first row and each of the at least one second rows are positioned at an angle selected from one of between 175° and 135°, between 170° and 140°, and between 160° and 150°.

9. An epilating apparatus comprising:

a first disc assembly arranged in a first row for rotating substantially in a first direction about a first axis; and at least one second disc assembly separate from the first, disc assembly arranged substantially in a second row detached from the first row for rotating substantially in the first direction about a respective second axis, wherein the first axis and the respective second axis are arranged angularly relative to each other at an angle between 175° and 135° wherein the first disc assembly and the at least one second disc assembly together impart a stretching effect on a surface.

10. The epilating apparatus according claim 9, wherein the angle is selected from one of between 170° and 140°, and between 160° and 150°.

* * * * *